United States Patent [19]

Baroky

[11] Patent Number: 4,819,308

[45] Date of Patent: Apr. 11, 1989

[54] ZIPPER GUARD

[76] Inventor: Julian K. Baroky, 1624 Shipman, Oxford, Mich. 48051

[21] Appl. No.: 167,517

[22] Filed: Mar. 14, 1988

[51] Int. Cl.[4] ..... A44B 19/30

[52] U.S. Cl. ..... 24/415; 24/418

[58] Field of Search ..... 24/415, 416, 417, 418, 24/427

[56] References Cited

U.S. PATENT DOCUMENTS

| | | | |
|---|---|---|---|
| 2,591,948 | 4/1952 | Lawson | 24/418 |
| 2,882,578 | 4/1959 | Morin | 24/415 |
| 4,409,705 | 10/1983 | Yuunaga | 24/415 |
| 4,562,622 | 1/1986 | Takabatake | 24/415 |

FOREIGN PATENT DOCUMENTS

| | | | |
|---|---|---|---|
| 0740226 | 11/1955 | United Kingdom | 24/416 |

*Primary Examiner*—Victor N. Sakran

*Attorney, Agent, or Firm*—John R. Benefiel

[57] ABSTRACT

An add-on guard piece for the slider of a zipper slide fastener configured to minimize the tendency for jamming with fabric, the guard piece generally crescent shaped and attached to the forward end of the slider by a spring clip having a loop portion received around the slider post and legs snap fit into a cavity in the guard piece. A close fit of entryway openings in the guard piece to the zipper clasp elements, and sloping diverter surfaces act to reduce the tendency for jamming with adjacent fabric.

3 Claims, 2 Drawing Sheets

ZIPPER GUARD

BACKGROUND OF THE INVENTION

This invention relates in general to slide fasteners, more commonly known as the zipper, and more particularly to a device attached to said slider to prevent jamming of such a fastener due to entanglement of fabric with the fastening clasp elements and slider thereof.

In slide fasteners of this type opposing clasp elements attached to fabric tapes 10 are drawn into converging openings on a slider element and pressed together therein so as to be interlocked. Especially when used on jackets, sleeping bags, etc., during the operation of the slider, the cooperating clasp elements are liable to contact and pick up or pinch adjacent fabric material. If such material gets between the clasp elements or between them and the slider, jamming results, not only arresting the opening or closing of the fastener, but often resulting in the tearing or damaging of the fabric. Another problem with such slide fasteners is the potential for bodily injury occurring when skin tissue is caught in the fastener.

It is therefore the object of the invention to provide a separate, readily attachable guard suitable for retrofitting conventional slide fasteners, which will divert adjacent fabric material away from the slider, to prevent catching and subsequent jamming as the slider is moved along.

Other objects of the invention are to provide an easily attachable guard which is inexpensive to manufacture, and easily adapted to any slide fastener size or shape.

Many other advantages, features and additional objects of the present invention will become manifest to those versed in the art upon making reference to the detailed description and the accompanying drawings in which a preferred embodiment incorporating the principles of the present invention is shown by way of illustrative example.

SUMMARY OF THE INVENTION

The present invention comprises a guard piece shaped to be fitted about the forward end of a slider, attached thereto by a spring clip received over the post of the slider and having ends spring fit into an inner recess in the guard piece. The guard piece is formed with sloping top and bottom diverter surfaces intermediate a pair of openings aligned with the entry ways of the slider element. The guard piece openings are closely fit to the clasp elements to prevent entry of fabric material. The guard piece is preferably molded of a relatively resilient material of a suitable plastic such as nylon to easily enable such close fit to the clasp elements, and assembly over the clasp elements by spreading of tape receiving side grooves extending along the guard piece to allow insertion of the clasp elements.

DETAILED DESCRIPTION

Figure 1:
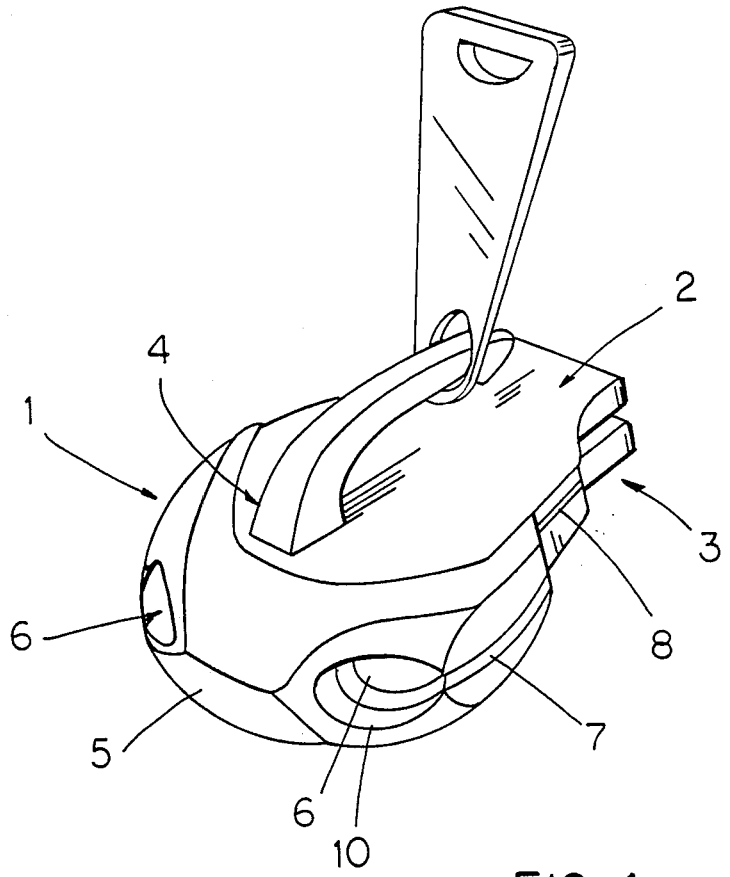
FIG. 1 is a perspective view of the zipper guard piece attached to a slide fastener.
Figure 2:
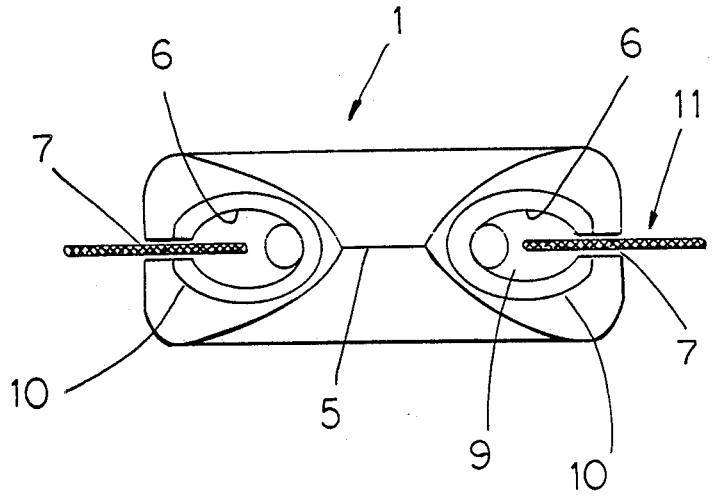
FIG. 2 is a front view of the zipper guard piece showing the lead and throughway openings, and the side grooves in relation to the clasp elements that are attached to fabric tapes.
Figure 3:
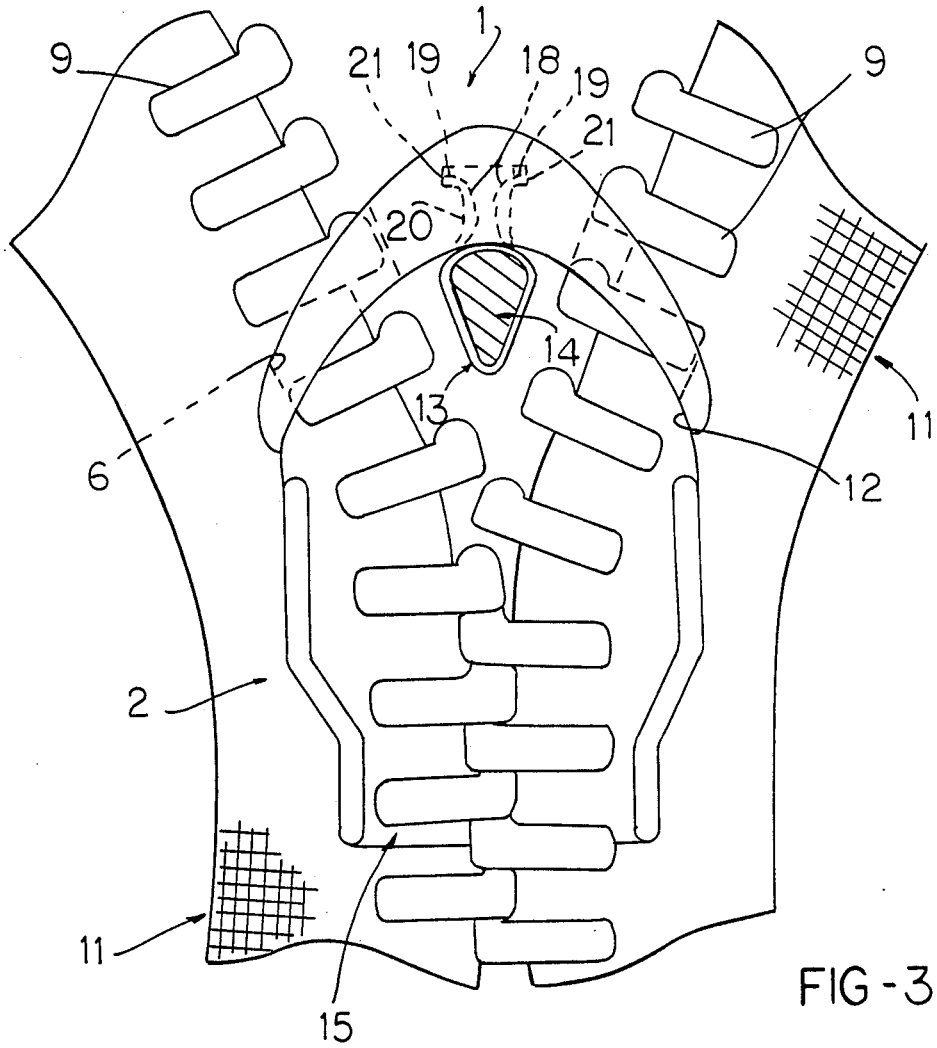
FIG. 3 is a partial cross-sectional view taken in the horizontal plane of the guard piece and attached slider element showing the adjacent clasp elements.
Figure 4:
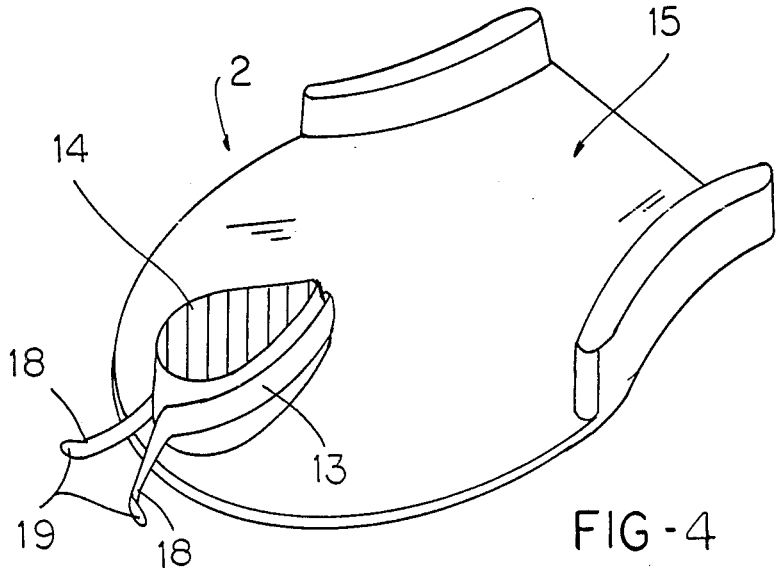
FIG. 4 is a perspective view in cross-section of the bottom half of a slide fastener with the attaching clip shown wrapped around the slider post.

The present invention is a snap-on guard 1, attachable to the front of the slide 2 of a conventional zipper fastener 3, which is generally crescent-shaped to allow the rear inside surface to be fit about the forward end 4 of the slide 2. The forward outside surface of the guard piece 1 has an outwardly angled projection 6 sloping from a leading edge 5 to the top and bottom surfaces of the slider 2 to divert material away from the top, side, and bottom surfaces of the fastening elements as the zipper is closed.

The guard piece 1 can be made of different materials, preferably molded of a suitable plastic such as nylon.

Two entryway openings 6 are provided on either side of the leading edge 5, with side grooves 7 aligned with the side grooves 8 of the slider 2. The openings 6 are sized to be closely fit to the clasp elements 9, therefore making it unlikely for anything, such as the adjacent fabric to get through to the slider. The molded plastic construction of the guard piece 1 allows such close fitting without jamming. However, because of the closer tolerance it may be necessary to form enlarged counterbores 10 at the beginning of each opening 6. This will contribute to the ease in which the clasp elements 9 can be started into the guard piece 1 and slider 2.

The entryway openings 6 are angled to be aligned with the entryway openings of the slides 2 so that the spacings between the converging clasp elements 9 is wider forward of the guard piece 1 to further reduce the tendency for snagging of fabric therebetween.

The grooves 7 on each side of the guard 1 are of a size determined by the width of the fabric tapes 11 which hold the clasp elements 9. The opening of the grooves 7 should be very close to the same size as the tape 11; this will also aid in diverting material away from the fastener when in operation. On plastic or nylon guards, the gap 10 can be formed smaller if required to create a slight drag on said tapes 11, thereby preventing slider 2 from backing down on its own.

As noted, the back side 12 of the guard 1 or section which comes in contact with the forward end 4 of the slider 2 is formed to closely fit the front contour of the slider 2.

The guard piece 1 is attached to the slider 2 by a spring clip 13 which is formed to fit closely around the slide fastener post 14—the post 14 being the section which forms top and bottom of the slider 2 together. The clip 13 is inserted up from the back of the throughway 15 of the slider 2. Once the clip 13 is in place around the post 14 there will be two diverging prongs 18 forming a "y" shape extending outward from the front of the slider 2. At the end of each prong 18 there is a tab 19 bent outward from each other. The two tabs 19 are then sprung together to be slid into a corresponding cavity 20 formed in the inside surface 12 of the guard 1 until matching side recesses 21 on the inside of the guard 1 match up with the tabs 19. At this point the tabs 19 will snap into place securing the guard 1 to the slider 2. The guard 1 is further stabilized by the fact that it rides snugly on the rows of interlocking clasp elements 9 or zipper track. The clip method of connection works well and does not interfere with the operation of the slider 2 if made to proper specifications; that being determined by the size of the slider 2. In most cases, the thickness of the clip 13 should not exceed 0.012 inches. It can be made of different materials, but preferably stainless steel No. 416 tempered to RC 42-45. The snap-on feature of this invention provide a big advantage making this product also suitable for retrofitting existing zippers.

Although various minor modifications may be suggested by those versed in the art, it should be understood that I wish to embody within the scope of the patent warranted hereon, all such embodiments as reasonable and properly come within the scope of my contribution to the art as defined by the following claims.

I claim:

1. A zipper guard which attaches to the slider of a zipper fastener, said slider having forward openings adapted to receive opposing clasp elements secured to respective tape pieces, said slider also including a post joining top and bottom halves of said slider, said guard comprising:

a guard piece having a rear inside surface and forward outside surface, said inside surface shaped to be fit to the forward end of said slider;

said guard having two entryway openings entering into the outside surface closely fit to receive said clasp elements to ride through and into said openings of said slider, said guard piece also having two grooves on each side extending into said entryway openings which are sized to receive a respective one of said tapes on which said clasp elements are attached;

a spring clip having a portion formed to fit closely around said slider post, said clip having forwardly projecting diverging legs, said guard piece being formed with a cavity formed into the inside surface adapted to receive said legs of said clip when pressed together, to connect said guard piece to said slider.

2. The zipper guard according to claim 1 wherein said guard piece is generally crescent shaped and made of plastic.

3. The zipper guard according to claim 2 wherein said guard piece outside surface is formed with a leading edge intermediate said entry way openings, and top and bottom sloping surfaces extend rearwardly to the top and bottom of said slider.

* * * * *